US008490612B2

(12) United States Patent
Shope, Jr.

(10) Patent No.: US 8,490,612 B2
(45) Date of Patent: Jul. 23, 2013

(54) METHOD OF STABILIZING OPALS

(76) Inventor: Thomas C. Shope, Jr., Charlotte, NC (US)

( * ) Notice: Subject to any disclaimer, the term of this patent is extended or adjusted under 35 U.S.C. 154(b) by 424 days.

(21) Appl. No.: 12/957,205

(22) Filed: Nov. 30, 2010

(65) Prior Publication Data

US 2011/0126815 A1 Jun. 2, 2011

Related U.S. Application Data

(60) Provisional application No. 61/265,158, filed on Nov. 30, 2009.

(51) Int. Cl.
*B25D 5/00* (2006.01)

(52) U.S. Cl.
USPC ..... 125/30.01; 264/138; 501/86; 451/28

(58) Field of Classification Search
USPC ..... 125/30.01; 451/28; 427/289, 290, 427/292, 430.1; 264/138, 157, 162; 501/86
See application file for complete search history.

(56) References Cited

U.S. PATENT DOCUMENTS

| | | | | |
|---|---|---|---|---|
| 2,394,502 | A * | 2/1946 | Weyl et al. | 501/59 |
| 3,202,741 | A * | 8/1965 | Gerson | 264/108 |
| 3,661,601 | A * | 5/1972 | Dumbaugh et al. | 501/59 |
| 4,050,947 | A * | 9/1977 | Ahlgren et al. | 501/30 |
| 4,940,477 | A * | 7/1990 | Bocko et al. | 65/17.4 |
| 5,021,260 | A * | 6/1991 | Kitagawa et al. | 427/140 |
| 5,407,988 | A * | 4/1995 | Kogowski | 524/394 |
| 5,559,060 | A * | 9/1996 | Dumbaugh et al. | 501/66 |
| 2002/0062782 | A1 * | 5/2002 | Norris et al. | 117/3 |
| 2007/0275844 | A1 * | 11/2007 | Bhandari | 501/86 |

* cited by examiner

*Primary Examiner* — George Nguyen

(57) ABSTRACT

The present invention protects opals during processing from rhyolite nodules. An opal containing rhyolite nodule is soaked in a heated polyester resin, styrene (100-42-5) solution for 24 hours per 10 grams of nodule. The rhyolite nodule is dried and sawed into slabs, which are soaked in a heated polyester resin, styrene (100-42-5) solution. The soaked slabs are cut into pieces, cabochons are marked out, and the pieces are rough cut into pre forms. The pre forms are soaked in a heated polyester resin, styrene (100-42-5) solution, beneficially for 24 hours. The pre forms are dried and cut into cabochons, which are soaked (preferably for 24 hours) in a heated polyester resin, styrene (100-42-5) solution. The soaked cabochons are then dried, polished, and air cured.

15 Claims, 1 Drawing Sheet

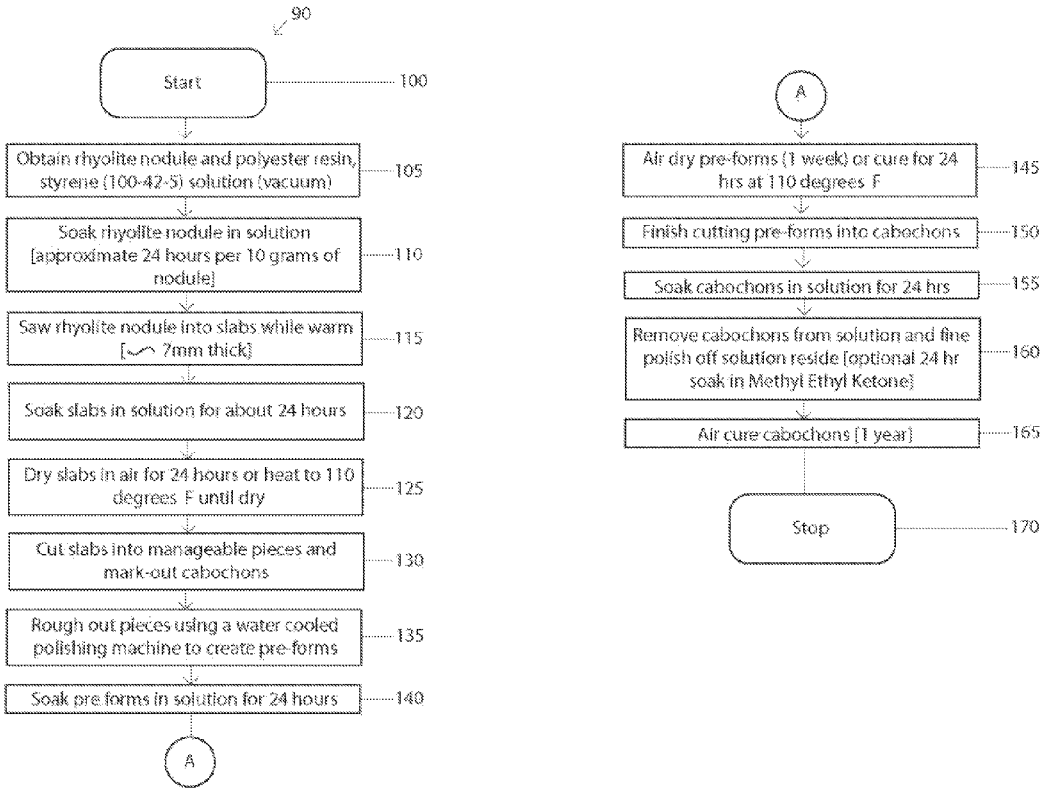

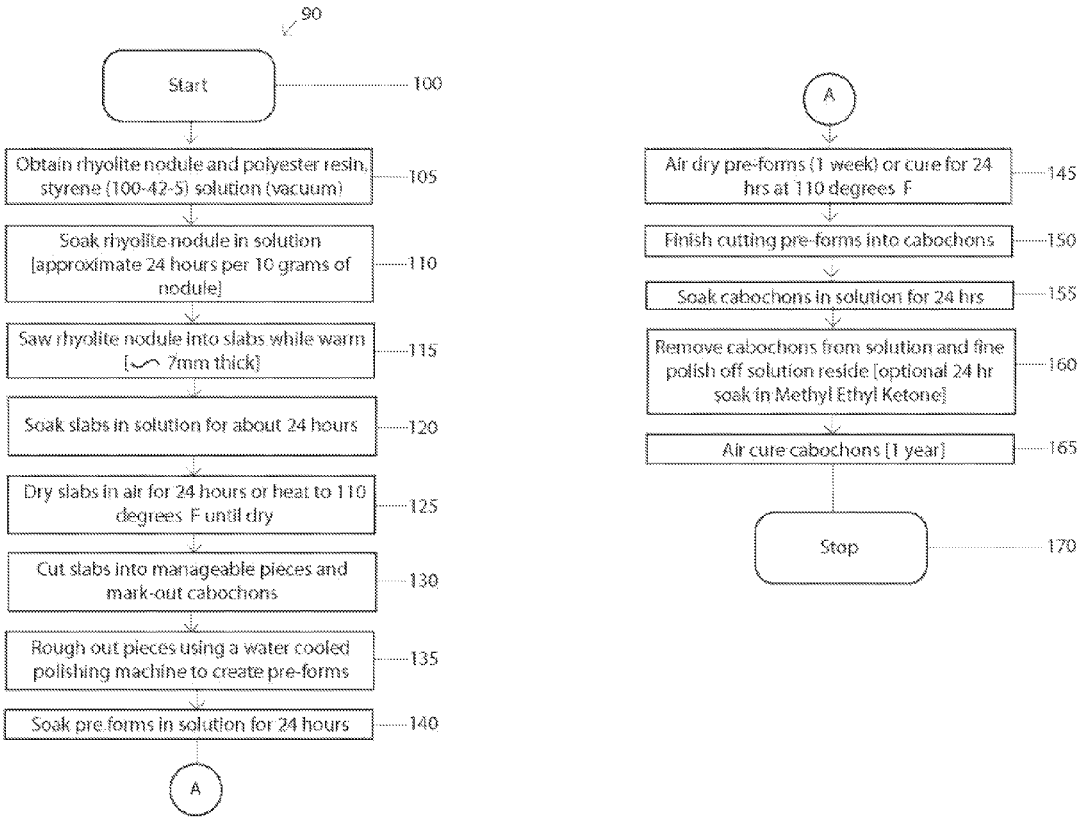
90
Start
100
Obtain rhyolite nodule and polyester resin, styrene (100-42-5) solution (vacuum)
105
Soak rhyolite nodule in solution [approximate 24 hours per 10 grams of nodule]
110
Saw rhyolite nodule into slabs while warm [~ 7mm thick]
115
Soak slabs in solution for about 24 hours
120
Dry slabs in air for 24 hours or heat to 110 degrees F until dry
125
Cut slabs into manageable pieces and mark-out cabochons
130
Rough out pieces using a water cooled polishing machine to create pre-forms
135
Soak pre forms in solution for 24 hours
140
A
A
Air dry pre-forms (1 week) or cure for 24 hrs at 110 degrees F
145
Finish cutting pre-forms into cabochons
150
Soak cabochons in solution for 24 hrs
155
Remove cabochons from solution and fine polish off solution reside [optional 24 hr soak in Methyl Ethyl Ketone]
160
Air cure cabochons [1 year]
165
Stop
170

METHOD OF STABILIZING OPALS

CROSS-REFERENCE TO RELATED APPLICATIONS

This application claims the benefit of U.S. Provisional Application No. 61/265,158 filed on Nov. 30, 2009.

FIELD OF THE INVENTION

The present invention generally relates to the field of gemstones. More particularly, this invention relates to a method of protecting opals during processing from rhyolite nodules so as to reduce or prevent fracturing and other damage.

BACKGROUND OF THE INVENTION

Jewelry and other adornments have been valued since antiquity. Initially, such items were likely made from carved animal bones or shells. Later, jewelry made from gems became highly valued as symbols of wealth and status and as mystical tokens for warding off evil spirits.

Gems are usually pieces of rock or mineral that are cut and polished to form jewelry or other adornment. While some gems are very rare and expensive, others are relatively common and are far less expensive. Furthermore, some gems are very hard, some are soft, some polish easily, others are far more difficult to polish. Some gems are faceted to produce optically pleasing effects while others are formed into cabochons to enhance visual attractiveness. As may be appreciated the art of forming gems into jewelry or other adornment is highly specialized.

One property in which gems differ greatly is their difficulty of fabricating. Some gems have few flaws and cleave cleanly, others have many minute structural flaws that cause the gem to shatter, crumble, or weirdly cleave when being worked. The more expensive the gem the more expensive a mistake becomes. One gem that is notoriously difficult to fabricate is the opal, a gem which occurs in Tertiary-age rhyolite flows. In particular, the African (Ethiopian) opal is particularly difficult to fabricate.

Opal creation began when rhyolite was extruded from within the Earth's crust. Sudden releases of pressure caused gases to separate from the fluid magma and to form large cavities and fractures. Hot water percolating through the silica-rich rhyolite took silica into solution, which filed the cavities and fractures. When the water evaporated silica-rich deposits formed. As this cycle repeated over and over again over a very long period of time the silica rich deposits formed opals, a substance that is as hard as glass.

The now-filled cavities containing opals are referred to as nodules. The rhyolite nodules are subsequently removed (mined) from the surrounding rock. Such nodules range from less than an inch to more than a foot in diameter. Opals found within the nodules are located in stratified fillings or closely-spaced layers. Removing opals from rhyolite nodules is difficult, particularly for the aforementioned African opal.

While an Opal in a rhyolite nodule is not particularly attractive, after proper processing a very striking and beautiful opal can result. Unfortunately, the geological process that produces opals causes such opals to having numerous fault lines that can produce unpredictable outcomes, such as high rates of breakage and stone waste, when being removed from the rhyolite nodule. Nonetheless, because of their beauty opals are highly valued and used extensively as jewelry and other adornments. But, because of the difficulty of removing an opal from a rhyolite nodule producing opals is a highly specialized skill.

Some other gems are also hard to fabricate, for example, Emeralds. In such instances an epoxy adhesive sold as OPTICON® Trademark No. 1,607,901 has been used to treat gems before and after cutting. One reason for this is that OPTICON fills fractures found in gemstones. This provides fracture "healing" in gems such as emeralds. After an emerald is cut and polished the optical properties of OPTICON can reduce the visibility of faults. It should be noted that this fracture healing and fault hiding is controversial within the jewelry business.

When OPTICON was tried on an African Opal before cutting it did not work. The African Opal was likely too dry and unstable for the filling properties of OPTICON to work successfully. In further tests it was determined that African Opals treated with OPTICON cracked far more than other similarly treated gems, including other opals. Consequently while OPTICON can be a valuable asset with other gems it is rarely used in the treatment of African and other opals.

Accordingly, there exists a need for a method of stabilizing opals, particularly African Opals, when being fabricated from a rhyolite nodule. There also exists a need for a method of stabilizing an opal in a manner that reduces or prevents fragmentation during fabrication. There also exists a further specific need for a method of stabilizing a complete non-cracked opal without fragmentation which further prevents fragmentation during cutting.

BRIEF SUMMARY OF THE INVENTION

The principles of the present invention provide for a technique of protecting opals in a manner that reduces or prevents fragmentation during processing of a rhyolite nodule to form opals. The method begins by soaking an opal containing rhyolite nodule in a polyester resin, styrene (100-42-5) solution that is heated to over 100° (preferably to)125° Fahrenheit. Beneficially a rhyolite nodule is soaked for 24 hours per 10 grams of nodule.

The rhyolite nodule is then dried and sawed into slabs. The slabs are soaked in a heated polyester resin, styrene (100-42-5) solution, preferably for about 24 hours. The soaked slabs are then cut into pieces while still warm. The cabochons are marked and then the pieces are rough cut into pre forms. The pre forms are soaked in a heated polyester resin, styrene (100-42-5) solution, beneficially for 24 hours.

The soaked pre forms are then dried and cut into cabochons. The cabochons are then soaked (preferably for 24 hours) in a heated polyester resin, styrene (100-42-5) solution. The soaked cabochons are then dried and polished. After polishing, if solution residue remains the polished cabochons can be soaked in Methyl Ethyl Ketene to remove such residue. In any event, after polishing the cabochons are cured in air (beneficially for about a year).

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

FIG. 1 is a flow diagram showing the processing steps of forming an opal cabochon from a rhyolite nodule.

DETAILED DESCRIPTION OF THE INVENTION

The presently disclosed subject matter will now be described more fully hereinafter with reference to the accompanying FIG. 1, in which some, but not all embodiments are shown. Indeed, this invention may be embodied in many different forms and should not be construed as limited to the specific embodiments set forth herein. Rather, these embodiments are provided so that this disclosure will satisfy applicable legal requirements.

FIG. 1 illustrates a flow diagram of a process 90 of forming an opal cabochon from a rhyolite nodule. As shown, the process 90 starts 100 and proceeds by obtaining an opal containing rhyolite nodule and a polyester resin, styrene (100-42-5) solution, step 105. The polyester resin, styrene (100-42-5) is essentially BONDO®, a registered trademark of the 3M Corporation, without filler. However, polyester resin, styrene (100-42-5) solution is available from other sources.

Throughout the process 90, polyester resin, styrene (100-42-5) solution is used at a temperature of greater than 100° Fahrenheit, preferably at 125° Fahrenheit. Heating is preferably performed using flameless heat. It is sometimes better to make use of the heated polyester resin, styrene (100-42-5) solution in an evacuated vacuum chamber (a hard vacuum is not required, simply enough vacuum to remove out gassing). Hereinafter, for simplicity and clarity, the heated polyester resin, styrene (100-42-5) solution, either evacuated or not, will generally be referred to simply as the solution.

The rhyolite nodule obtained in step 105 is then soaked in the solution for 24 hours per 10 grams, step 110. This ensures that the external fissures of the rhyolite nodule are filled with the solution. After step 110 the rhyolite nodule is removed from the solution and while still warm sawed into slabs, beneficially about 7 mm thick, step 115.

After sawing, the slabs are soaked in the solution for about 24 hours to allow the solution to fill the external fissures of the slabs, step 120. Then, the slabs are dried, step 125. Drying can be performed by air drying for about 24 hours or by heating the slabs to about 110° Fahrenheit until dry.

After step 125, the now dry slabs are cut into manageable pieces and the desired cabochons are marked out, step 130. This is a highly artistic process that can best be performed using an artisan's eye and feel. The marked up pieces are then rough cut, beneficially using a water-cooled polishing machine, to form pre-forms, step 135. The pre-forms are then soaked in the solution for 24 hours, step 140.

After step 140, the pre-forms are removed from the solution and dried, again either air dried for 24 hours or by heating to about 110° Fahrenheit until dry, step 145. The now-dry pre-forms are then finish cut into the marked out cabochons, step 150. The cabochons are then soaked in the solution for 24 hours, step 155.

After soaking, the cabochons are removed from the solution and fine polished. A goal of fine polishing (besides enhancing the beauty of the opal) is to remove (polish off) solution residue, step 160. If all of the solution residue cannot be removed the polished cabochon can be soaked for 24 hours in Methyl Ethyl Ketone (MEK) or a similar liquid that removes the polyester resin, styrene (100-42-5).

Finally, the cabochons are beneficially air cured for about 1 year, step 165. The process 90 then stops, step 170.

It is to be understood that while the figures and the above description illustrate the present invention, they are exemplary only. They are not intended to be exhaustive or to limit the invention to the precise forms disclosed, and obviously many modifications and variations are possible in light of the above teaching. Others who are skilled in the applicable arts will recognize numerous modifications and adaptations of the illustrated embodiments that remain within the principles of the present invention. Therefore, the present invention is to be limited only by the appended claims.

What is claimed:

1. A method of processing opals from rhyolite nodules, comprising soaking a rhyolite nodule in a polyester resin, styrene (100-42-5) solution heated to over 100° Fahrenheit and sawing the rhyolite nodule into slabs.

2. The method according to claim 1, further comprising a step of soaking said slabs in a polyester resin, styrene (100-42-5) solution.

3. The method according to claim 2, further comprising steps of cutting said soaked slabs into pieces, marking out cabochons, and rough cutting said soaked slabs into pre forms.

4. The method according to claim 3, further comprising a step of soaking said pre forms in a polyester resin, styrene (100-42-5) solution.

5. The method according to claim 4, further comprising a step of cutting said pre forms into cabochons.

6. The method according to claim 5, further comprising a step of soaking said cabochons in a polyester resin, styrene (100-42-5) solution.

7. The method according to claim 6, further including the step of polishing said soaked cabochons.

8. The method according to claim 6, further including the step of soaking said polished cabochons in Methyl Ethyl Ketene.

9. The method according to claim 6, further including the step of curing said polished cabochon in air for about a year.

10. The method according to claim 1 wherein said polyester resin, styrene (100-42-5) solution is heated to 125° Fahrenheit.

11. The method according to claim 1 wherein said soaking is performed for 24 hours per 10 grams of rhyolite nodule.

12. The method according to claim 1 wherein said soaking is performed under vacuum.

13. A method of processing opals from rhyolite nodules, comprising the steps of:

soaking a rhyolite nodule in a polyester resin, styrene (100-42-5) solution heated to over 100° Fahrenheit;

drying said soaked rhyolite module;

sawing said rhyolite nodule into slabs;

soaking said slabs in a polyester resin, styrene (100-42-5) solution heated to over 100° Fahrenheit;

cutting said soaked slabs into pieces marking out cabochons, and rough cutting said soaked slabs into pre forms;

soaking said pre forms in a polyester resin, styrene (100-42-5) solution heated to over 100° Fahrenheit;

cutting said pre forms into cabochons soaking said cabochons in a polyester resin, styrene (100-42-5) solution heated to over 100° Fahrenheit;

polishing said soaked cabochons; and curing said soaked cabochon in air.

14. The method according to claim 13 wherein soaking said rhyolite nodule is performed under vacuum.

15. The method according to claim 13 wherein said step of soaking a rhyolite nodule in a polyester resin, styrene (100-42-5) solution is performed when said solution is heated to 125° Fahrenheit.

* * * * *